US007262739B2

(12) United States Patent
Chen

(10) Patent No.: US 7,262,739 B2
(45) Date of Patent: Aug. 28, 2007

(54) MONOPOLE ANTENNAS

(75) Inventor: Chih-Lung Chen, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 55 days.

(21) Appl. No.: 11/313,867

(22) Filed: Dec. 20, 2005

(65) Prior Publication Data

US 2007/0030199 A1 Feb. 8, 2007

(30) Foreign Application Priority Data

Aug. 3, 2005 (TW) ..... 94126332 A

(51) Int. Cl.
*H01Q 21/00* (2006.01)

(52) U.S. Cl. ..... 343/725; 343/700 MS; 343/702

(58) Field of Classification Search ..... 343/700 MS, 343/702, 846, 725
See application file for complete search history.

(56) References Cited

U.S. PATENT DOCUMENTS 6,392,599 B1 5/2002 Ganeshmoorthy et al.

6,809,687 B2 * 10/2004 Yuanzhu ..... 343/700 MS

FOREIGN PATENT DOCUMENTS

JP 04120902 4/1992

OTHER PUBLICATIONS

Maria A. Stuchly et al, "Modeling Antenna Close to the Human Body," *IEEE*, vol. 5, 2000, pp. 83-89, USA.

* cited by examiner

*Primary Examiner*—Hoang V. Nguyen
(74) *Attorney, Agent, or Firm*—Quintero Law Office

(57) ABSTRACT

Monopole antennas are provided. A monopole antenna transmitting radio signals within a specific frequency range includes a substrate, a ground, a first sleeve portion, a second sleeve portion, a first conductive element, a second conductive element and a cable. The first conductive element and the ground are formed on the substrate. The first and second sleeves electrically connect the ground and project from a side of the ground in a first direction. The first conductive element comprises a feed end and a connection portion adjacent to an edge of the substrate. The second conductive element connects the connection portion and projects from the edge of the substrate substantially in the first direction. The cable connects the ground and the feed end to transmit the radio signal.

25 Claims, 12 Drawing Sheets

MONOPOLE ANTENNAS

BACKGROUND OF THE INVENTION

1. Field of the Invention

The invention relates in general to monopole antennas and in particular to monopole antennas for UHF/VHF radio signals.

2. Description of the Related Art

Embedded antennas, such as chip antennas and planar antennas, are widely applied in wireless communication devices. A conventional type is a ceramic chip antenna produced by LTCC (Low Temperature Co-fired Ceramic) technology. Conventional planar antennas such as microstrip antennas, printed antennas and planar Inverted F Antennas (PIFAs), are generally applied in GSM, DCS, UMTS, WLAN, and Bluetooth wireless equipment such as mobile phones and wireless LAN adapters.

Referring to FIG. 1, a conventional planar monopole antenna primarily comprises a substrate S, a ground G, a conductive element R and a cable W. The ground G and the conductive element R are formed on a surface S1 of the substrate S with the conductive element R longitudinal in direction Y.

The cable W, such as a coaxial cable, comprises a signal wire W1 enclosed by a ground wire W2. As shown in FIG. 1, the conductive element R comprises a feed end RF adjacent to the ground G. The feed end RF is connected to the signal wire W1, and the ground G is connected to the ground wire W2, respectively.

With regard to typical frequency range of Digital Video Broadcasting, the frequency coverage ratio of a conventional planar monopole antenna is usually less than 30%, adversely affecting communication efficiency. Moreover, it is not convenient to switch between VHF and UHF during usage due to bandwidth limitations of conventional planar monopole antennas.

BRIEF SUMMARY OF THE INVENTION

Monopole antennas are provided. An embodiment of a monopole antenna transmitting radio signals within a specific frequency range includes a substrate, a ground, a first sleeve portion, a second sleeve portion, a first conductive element, a second conductive element and a cable. The first conductive element and the ground are formed on the substrate. The first and second sleeves electrically connect the ground and project from a side of the ground in a first direction. The first conductive element comprises a feed end and a connection portion adjacent to an edge of the substrate. The second conductive element connects the connection portion and projects from the edge of the substrate substantially in the first direction. The cable connects the ground and the feed end to transmit the radio signal.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
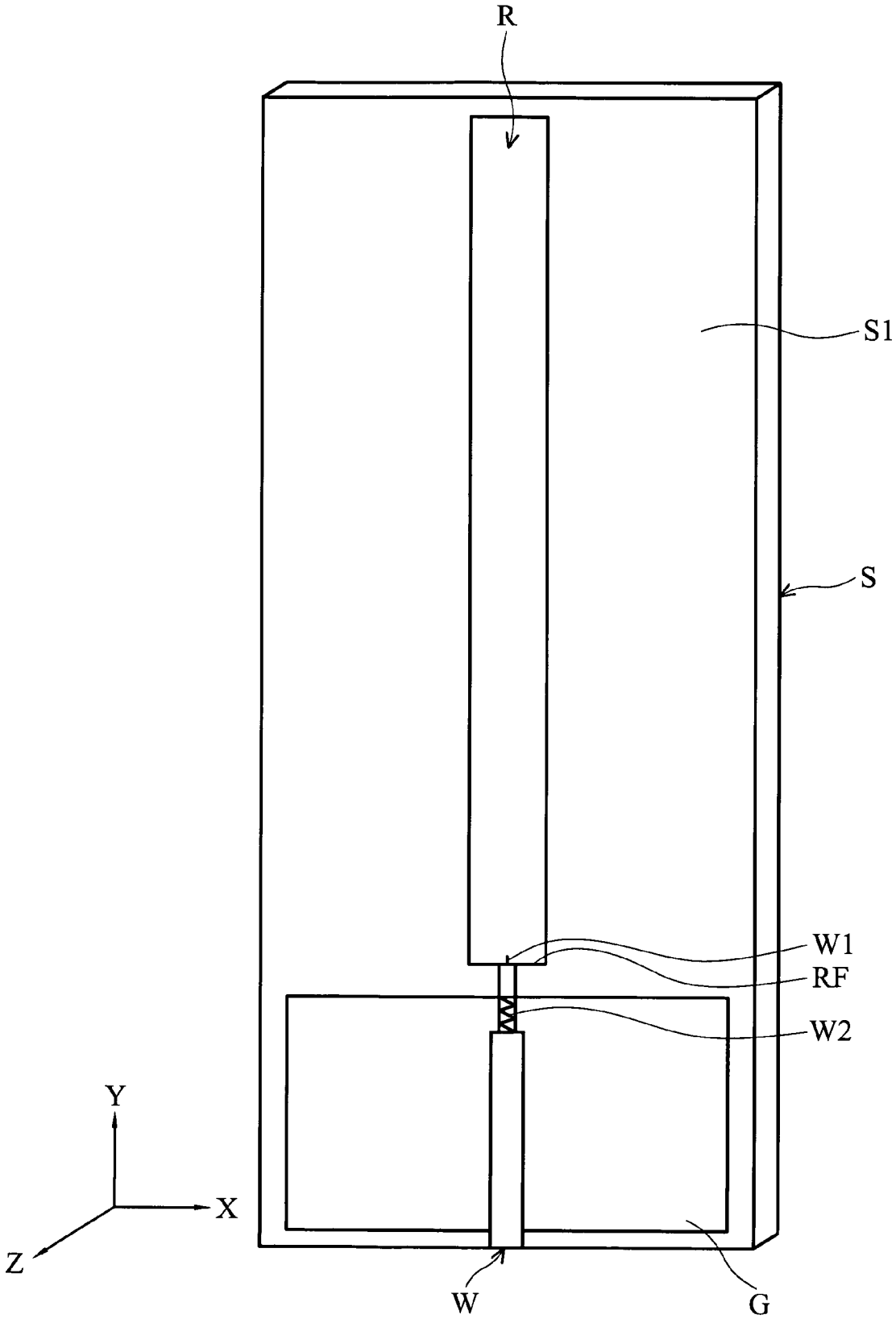
FIG. 1 (RELATED ART)
FIG. 1 is a perspective diagram of a conventional monopole antenna.
Figure 2A:
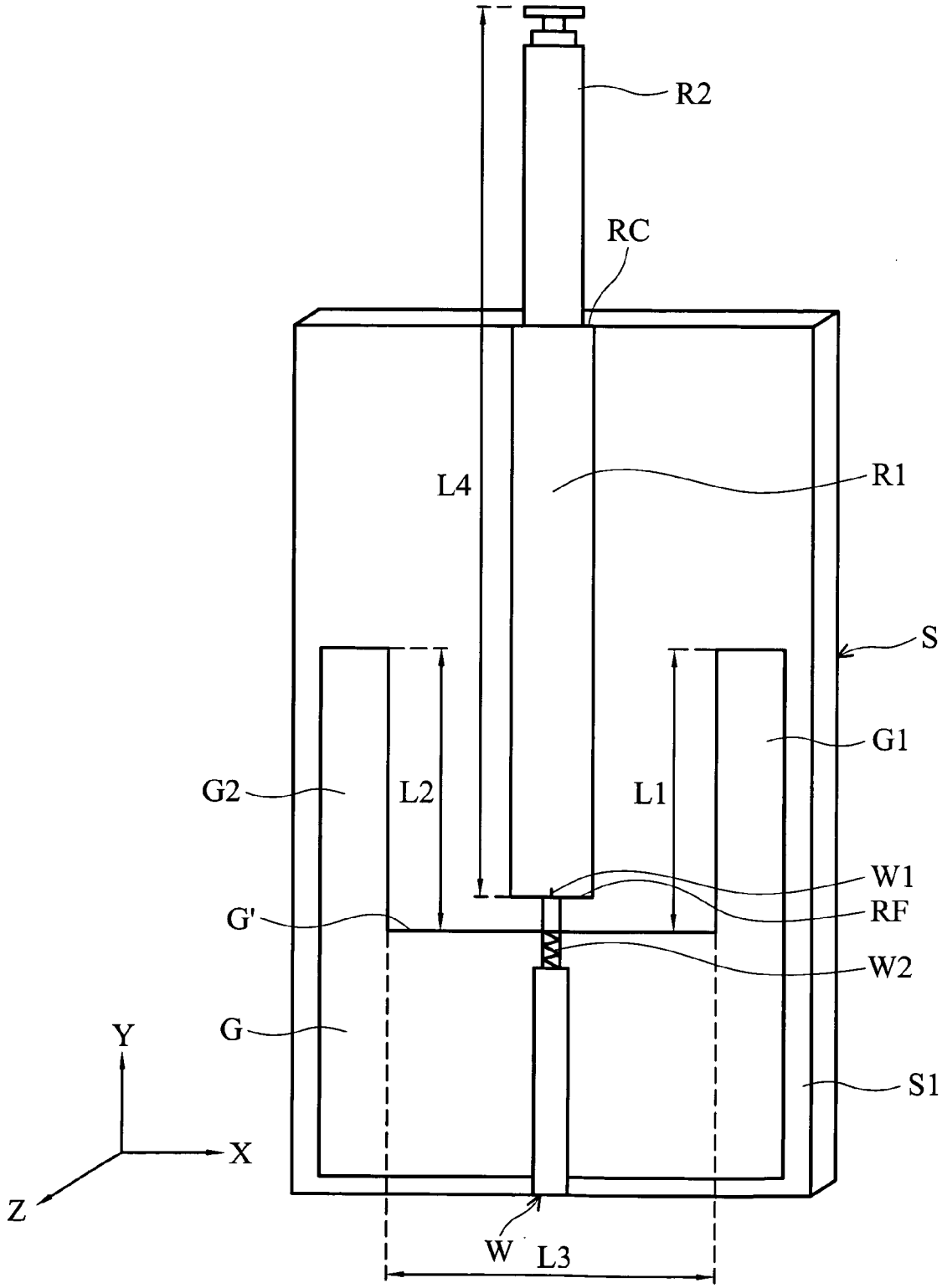
FIGS. 2A and 2B are perspective diagrams of an embodiment of a monopole antenna.
Figure 2B:
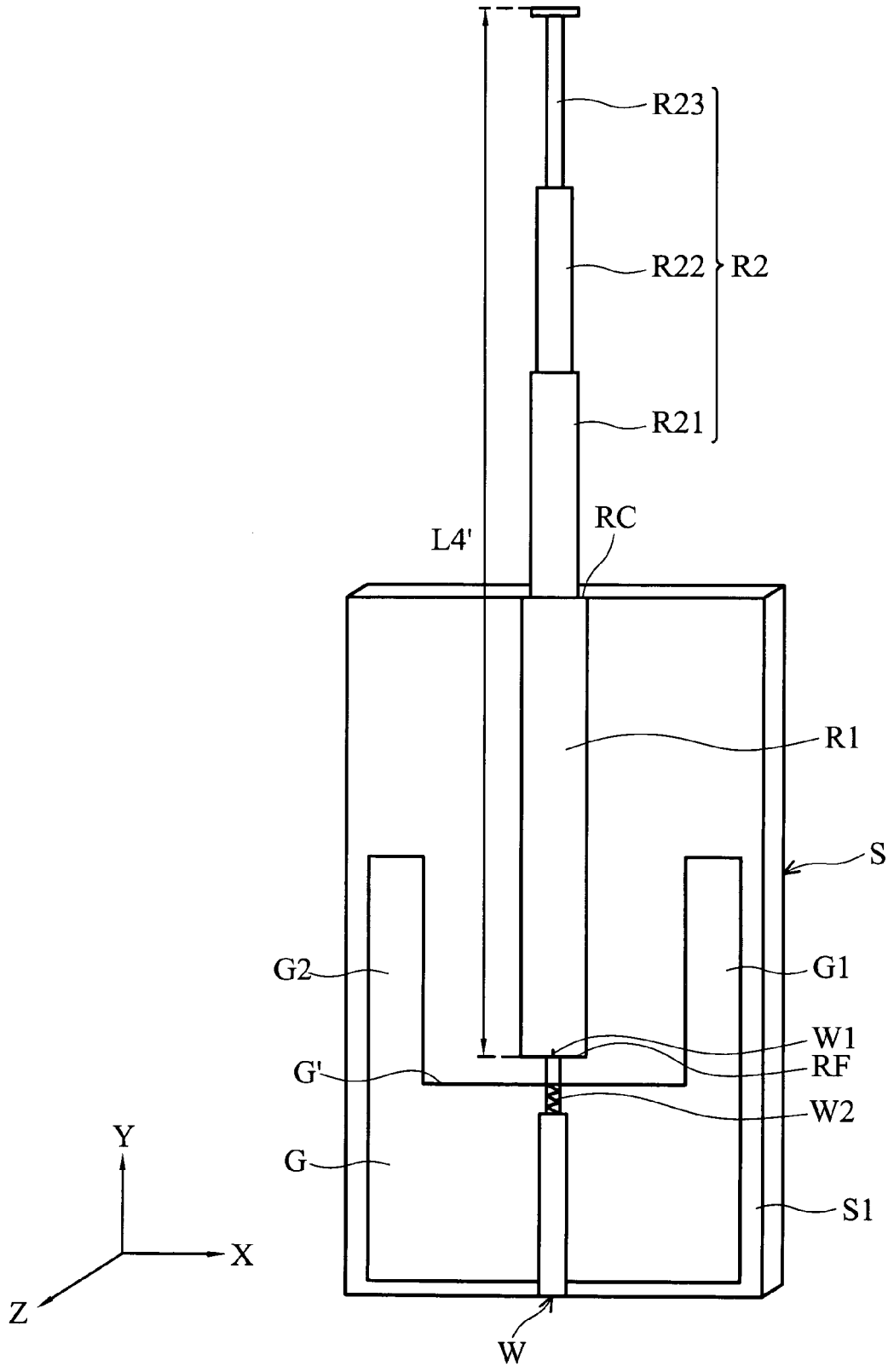

Referring to FIGS. 2A and 2B, an exemplary embodiment of a monopole antenna transmitting radio signals within a specific frequency range includes a substrate S, a ground G, a first sleeve G1, a second sleeve G2, a first conductive element R1, a second conductive element R2 and a cable W. The ground G and the conductive element R1 are formed on a surface S1 of the substrate S. The second conductive element R2 is retractable along Y axis and connected to a connection portion RC of the first conductive element R1, wherein the connection portion RC is adjacent to an edge of the substrate S. Specifically, the second conductive element R2 projects from the edge of the substrate S.

As shown in FIG. 2A, the first conductive element R1 is longitudinal in direction Y and comprises a feed end RF at an end thereof. The feed end RF is adjacent to a side G' of the ground G, substantially parallel to the X axis. The cable W, such as a coaxial cable, comprises a signal wire W1 and enclosed by a ground wire W2. The signal wire W1 is connected to the feed end RF, and the ground wire W2 is connected to the ground G, respectively.

The first and second sleeves G1 and G2 are parallel and formed on the surface S1 with the first conductive element R disposed therebetween. As shown in FIG. 2A, the first sleeve G1 has a first length L1, and the second sleeve G2 has a second length L2, both projecting from the side G' of the ground G in direction Y, wherein the first length L1 is substantially equal to the second length L2. In some embodiments, the substrate S is FR4 (Flame Retardant Type 4), and the ground G, the first and second sleeves G1 and G2 are metal, integrally formed on the surface S1 by PCB fabrication.

When the second conductive element R2 is retracted, as shown in FIG. 2A, total length L4 of the first and second conductive elements R1 and R2 is substantially equal to ¼ of a specific UHF radio signal wavelength. Further, the length L4 is also substantially equal to the sum of the first, second and third lengths L1, L2 and L3 (L4=L1+L2+L3), wherein the third length L3 indicates the length of the side G' (the distance between the sleeves G1 and G2). Thus, the first conductive element R1, the first and second sleeves G1 and G2 can exhibit capacitive effect and facilitate broader bandwidth for wireless communication.

Referring to FIG. 2B, when the monopole antenna is applied for VHF radio signal communications, the second conductive element R2 is extended from length L4 to L4' (L4'>L4) in a first direction (direction Y), wherein length L4' is substantially equal to ¼ of a specific VHF radio signal wavelength. In some embodiments, total length of the first and second conductive elements R1 and R2 can also be adjusted substantially to ¼ of a GSM radio signal wavelength for wireless communication.

As shown in FIG. 2B, the second conductive element R2 is retractable and comprises a first section R21, a second section R22 and a third section R23 telescopically connected along Y axis. When the second conductive element R2 is extended, total length of the first and second conductive elements R1 and R2 is increased along Y axis, facilitating wireless communication efficiency of VHF radio signals. In some embodiments, the second conductive element R2 comprises two or more sections telescopically connected along Y axis, such that the length of the second conductive element R2 is adjustable.

Figure 3A:
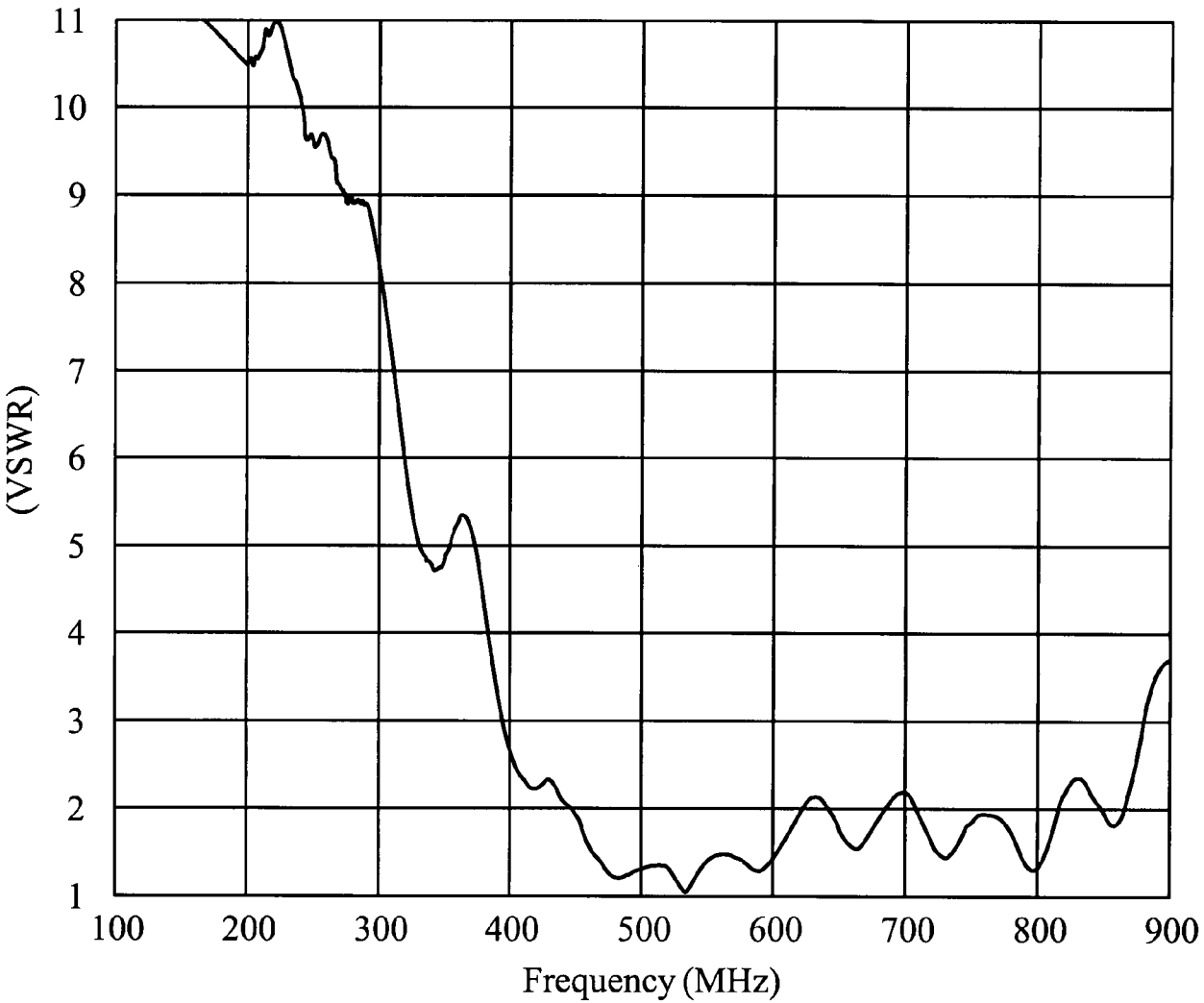
FIG. 3A is a perspective diagram illustrating VSWR between 100-900 MHz of the monopole antenna in FIG. 2A.
Figure 3B:
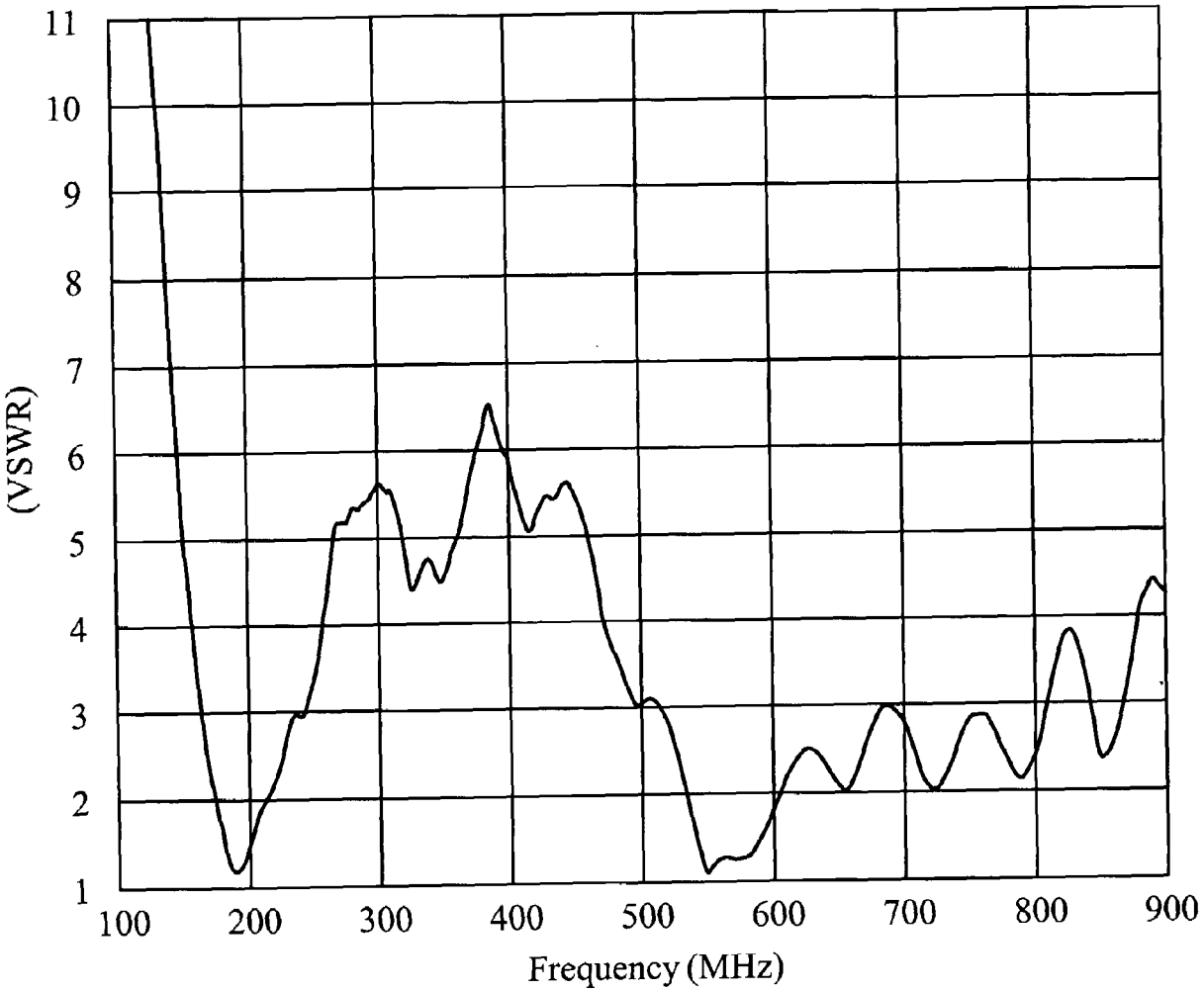
FIG. 3B is a perspective diagram illustrating VSWR between 100-900 MHz of the monopole antenna in FIG. 2B.

FIGS. 3A and 3B illustrate Voltage Standing Wave Ratio (VSWR) between 100-900 MHz of the monopole antenna in FIGS. 2A and 2B, respectively. In general, a standard antenna requires an available VSWR less than 3. With respect to FIG. 3A, when the second conductive element R2 is retracted as shown in FIG. 2A, available frequency range under VSWR<3 is between 400-860 MHZ, substantially covering the bandwidth of UHF (460-860 MHZ). Referring to FIG. 3B, when the second conductive element R2 is extended as shown in FIG. 2B, available frequency range under VSWR<3 substantially covers two bandwidths of UHF (460-860 MHZ) and VHF (170-2300 MHZ).

With extension of the second conductive element R2 in FIG. 2B, communication efficiency of UHF (460-860 MHZ) may decrease slightly, however, it can still meet the requirement of VSWR<3. Since both bandwidths of UHF (460-860 MHZ) and VHF (170-2300 MHZ) can be substantially covered by extension of the second conductive element R2, it is not necessary to provide antennas for UHF and VHF individually, reducing production cost and facilitating convenience.

Figure 4:
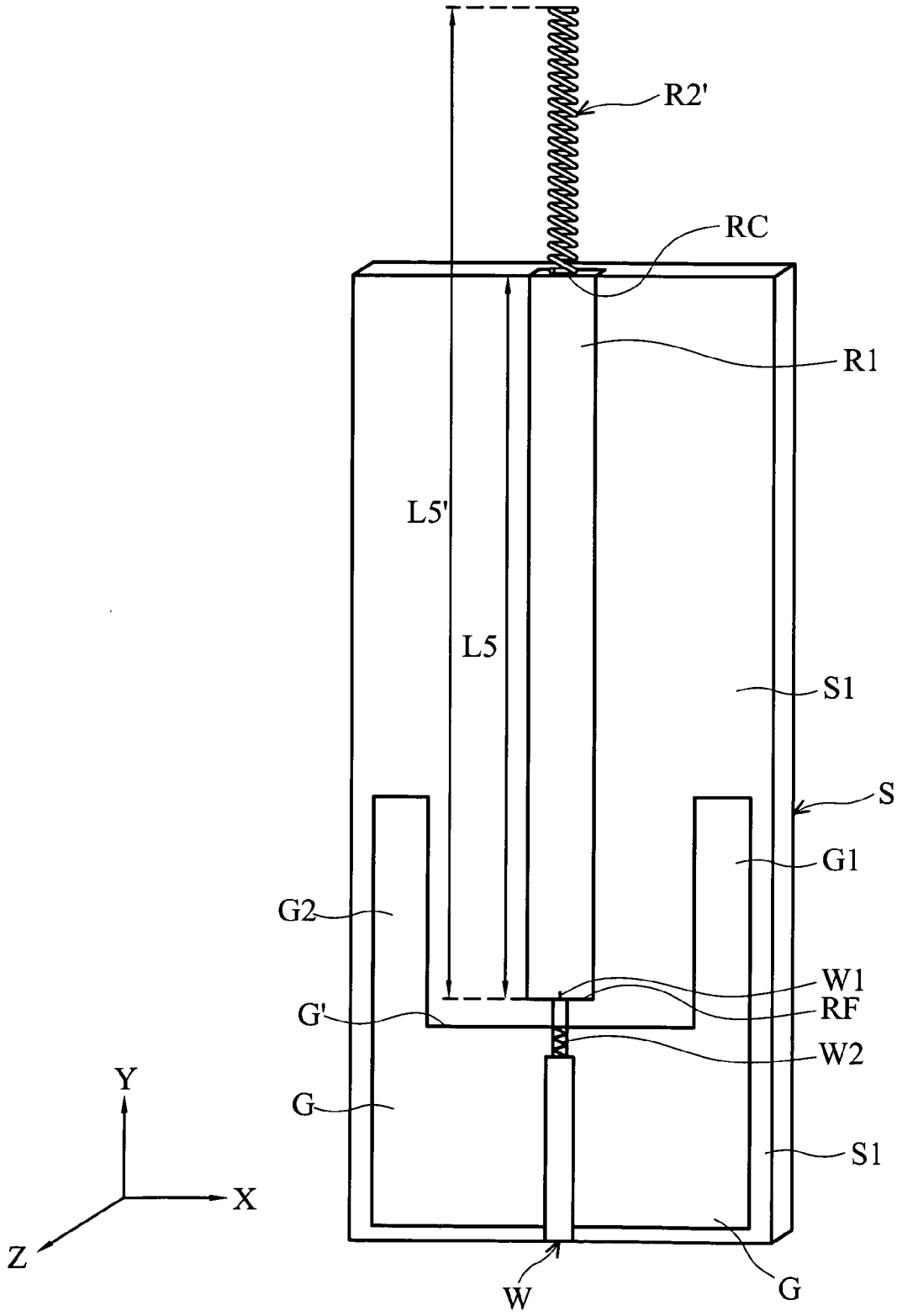
FIG. 4 is a perspective diagram of another embodiment of a monopole antenna.

FIG. 4 shows another embodiment of a monopole antenna. Unlike the monopole antenna in FIGS. 2A and 2B, here, the second conductive element R2' is a spiral conductor, substituted for the telescopic conductive element R2 in FIGS. 2A and 2B. In FIG. 4, the second conductive element R2' connects a connection portion RC at an end of the first conductive element R1 and projects from an edge of the substrate S in the first direction (direction Y). In this embodiment, the length L5 of the first conductive element R1 is substantially equal to ¼ of a specific UHF radio signal wavelength. Further, the length L5 is also substantially equal to the sum of the lengths of the first sleeve G1, the second sleeve G2 and the side G' (the distance between the sleeves G1 and G2).

Referring to FIG. 4, total length L5' of the first and second conductive elements R1 and R2' in direction Y exceeds the length L5 of the first conductive element R1, providing analogous functions such as the extendable conductive element R2 in FIG. 2B, capable of wireless communications for UHF (460-860 MHZ) and VHF (170-2300 MHZ). In this embodiment, the length L5' of the first and second conductive elements R1 and R' is configured corresponding to ¼ of a specific VHF radio signal wavelength, and the length of the second conductive element R2' in direction Y is configured according to its spiral radius and actual extended length. As the length of the spiral-shaped conductive element R2' along Y axis is less than its actual extended length, the extent of the antenna is reduced.

Figure 5:
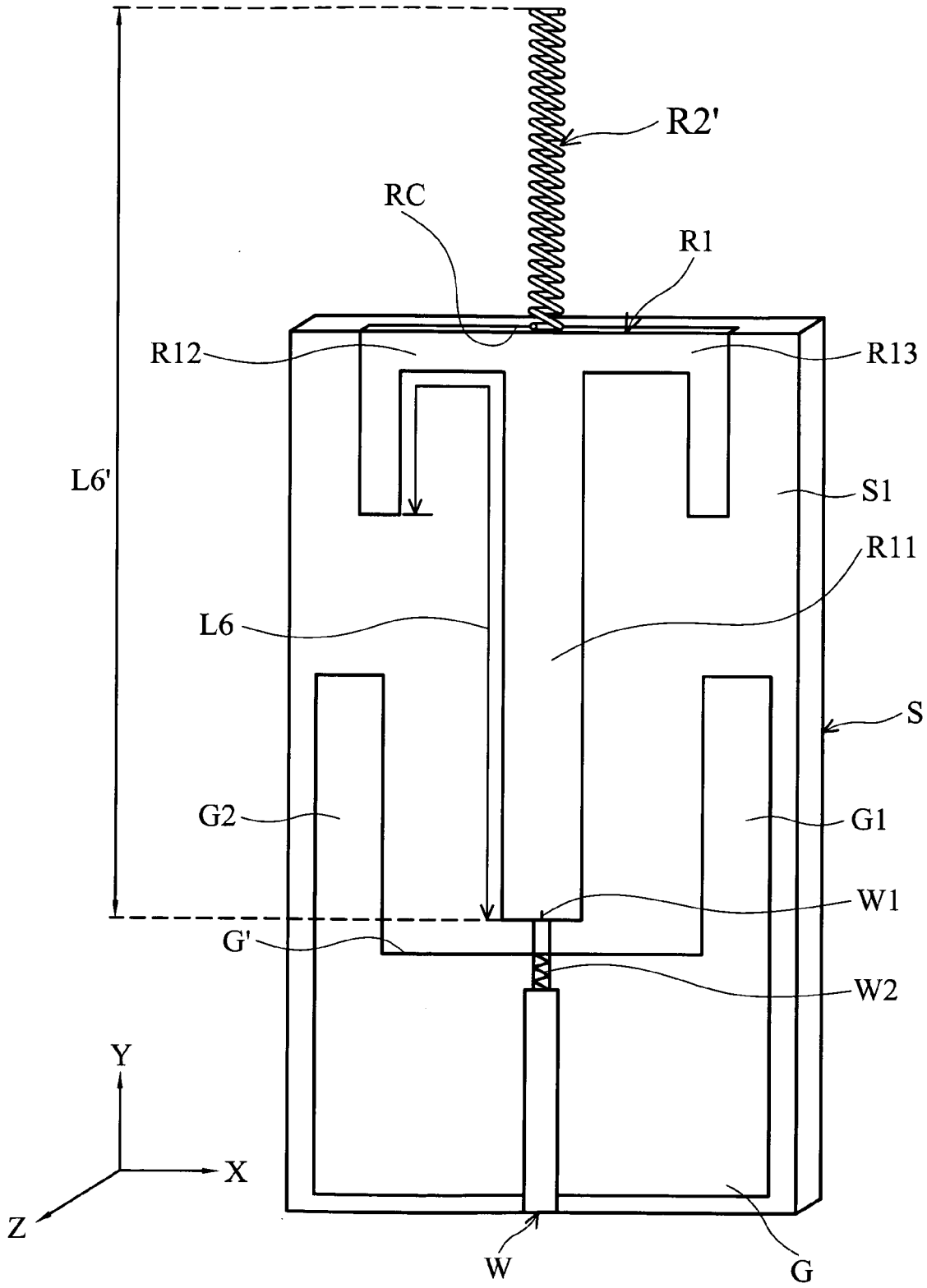
FIG. 5 is a perspective diagram of another embodiment of a monopole antenna.

FIG. 5 shows another embodiment of a monopole antenna. In FIG. 5, the first conductive element R1 comprises a main body R11 and a pair of L-shaped angle portions R12 and R13 symmetrically disposed with respect to the main body R1. Specifically, the angle portions R12 and R13 connect an end of the main body R11 and extend opposite to direction Y. In this embodiment, total length L6 of the main body R11 and each of the angle portions R12 and R13 is substantially equal to ¼ of a specific UHF radio signal wavelength. Further, total length L6' of the first and second conductive elements R1 and R2' in direction Y is configured corresponding to a specific VHF radio signal wavelength, and the length of the second conductive element R2' in direction Y is configured according to its spiral radius and actual extended length. Owing to the configuration of the first conductive elements R1 with the angle portions R2 and R3 extended opposite to direction Y, the extent of substrate S and the first conductive element R1 of the antenna is reduced in direction Y.

Figure 6:
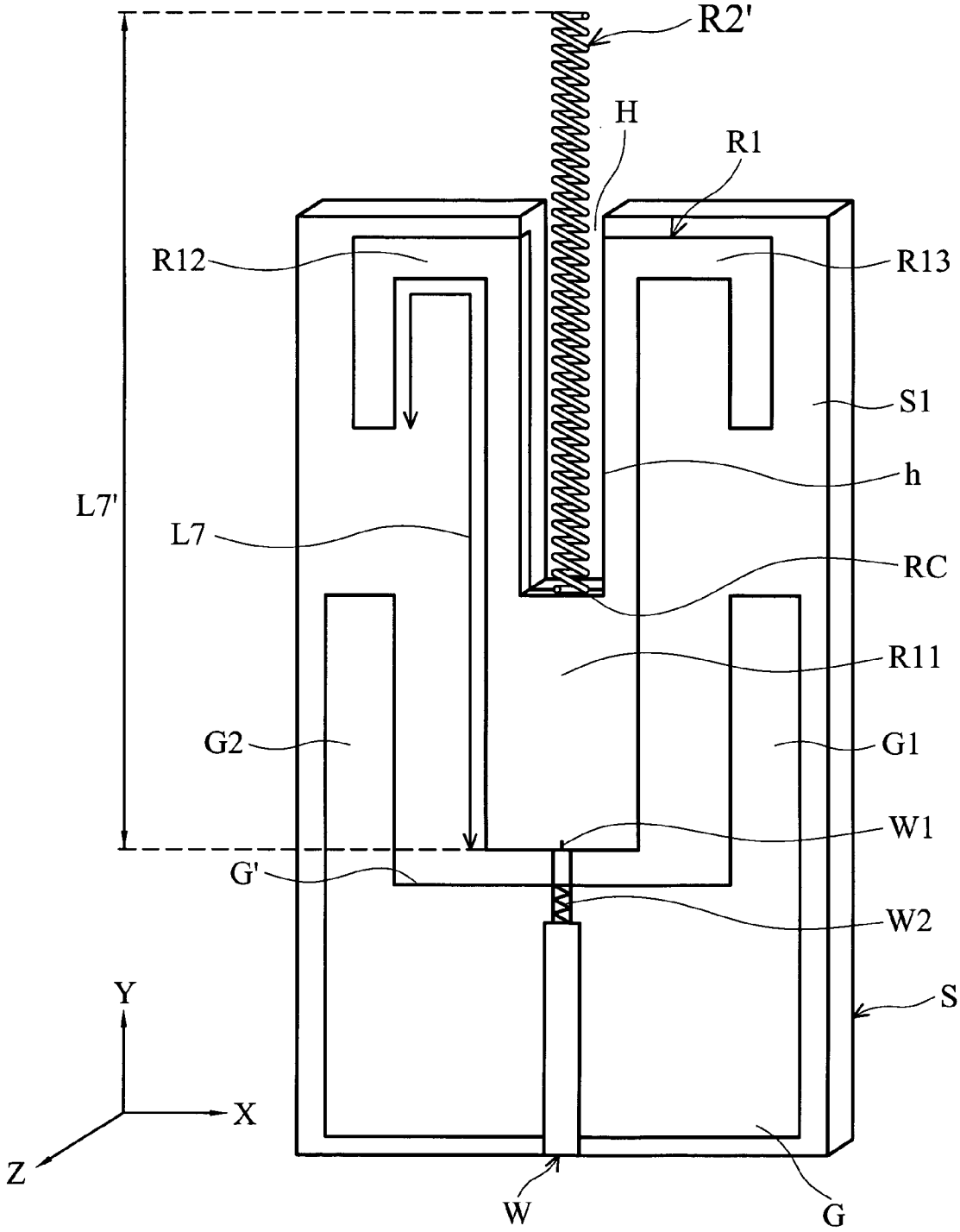
FIG. 6 is a perspective diagram of another embodiment of a monopole antenna.

FIG. 6 shows another embodiment of a monopole antenna. As shown in FIG. 6, a substrate S comprises a slot H, and the main body R11 of the first conductive element R1 comprises a depression h corresponding to the slot H. In this embodiment, total length L7 of the main body R11 and each of the angle portions R2 and R3 is substantially equal to ¼ of a specific UHF radio signal wavelength. Further, total length L7' of the first and second conductive elements R1 and R2' along Y axis is configured corresponding to a specific VHF radio signal wavelength, and the length of the second conductive element R2' in direction Y is configured according to its spiral radius and actual extended length. Since the second conductive element R2' is received in the slot H and connected to the connection portion RC, the extent of the antenna in direction Y is reduced.

Figure 7:
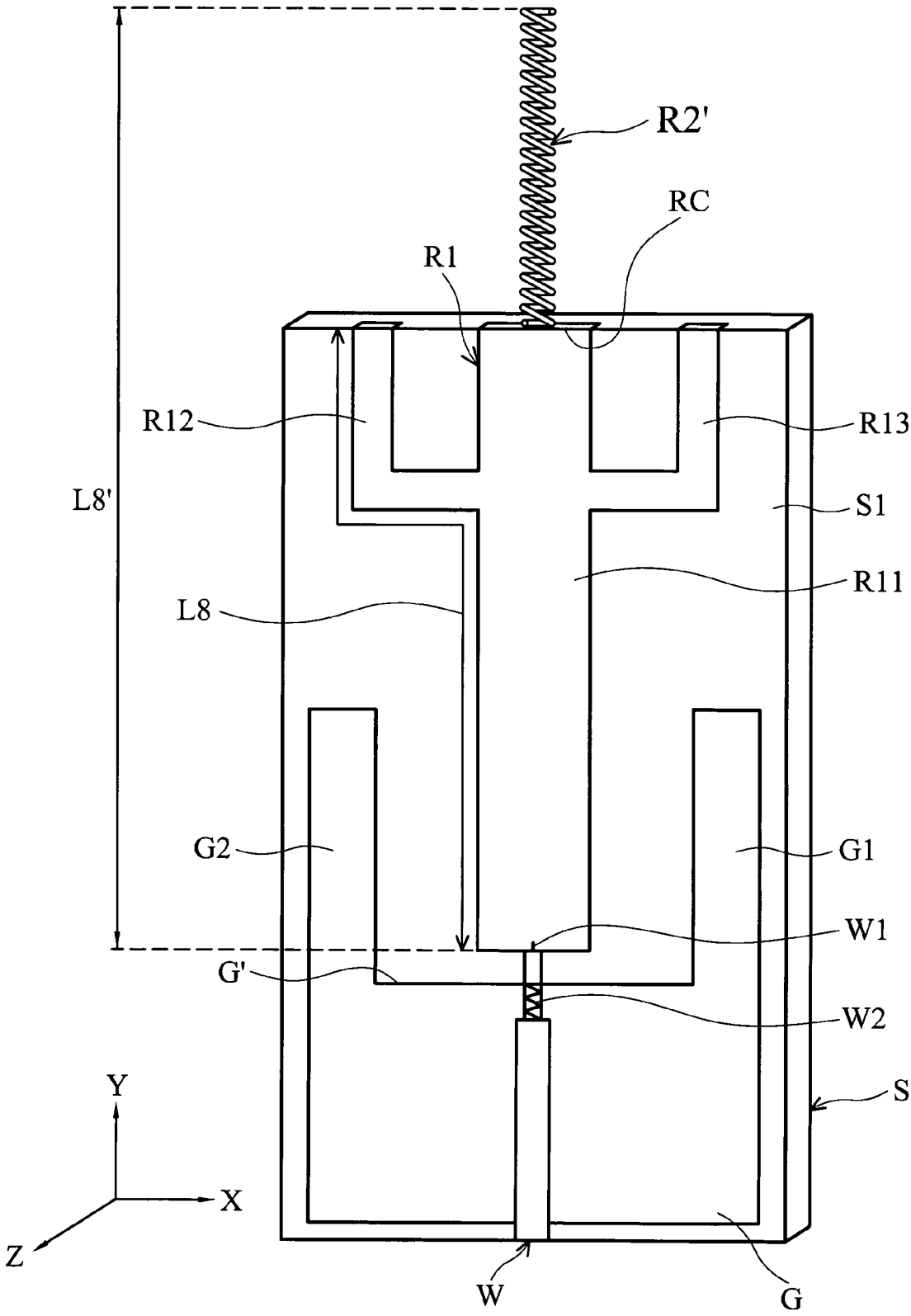
FIG. 7 is a perspective diagram of another embodiment of a monopole antenna.

FIG. 7 shows another embodiment of a monopole antenna. As shown in FIG. 7, the L-shaped angle portions R12 and R13 are symmetrically disposed on opposite sides of the main body R11 of the first conductive element R1. Unlike the monopole antenna in FIG. 5, here, the two angle portions R12 and R13 connect to the middle of the main body R11 and extend in the first direction (direction Y), however, the angle portions R12 and R13 can also connect to other portions of the main body R11. In some embodiments, total length L8 of the main body R11 and each of the angle portions R12 and R13 is substantially equal to ¼ of a specific UHF radio signal wavelength. Further, total length L8' of the first and second conductive elements R1 and R2' in direction Y is configured corresponding to a specific VHF radio signal wavelength, and the length of the second conductive element R2' in direction Y is configured according to its spiral radius and actual extended length.

Figure 8:
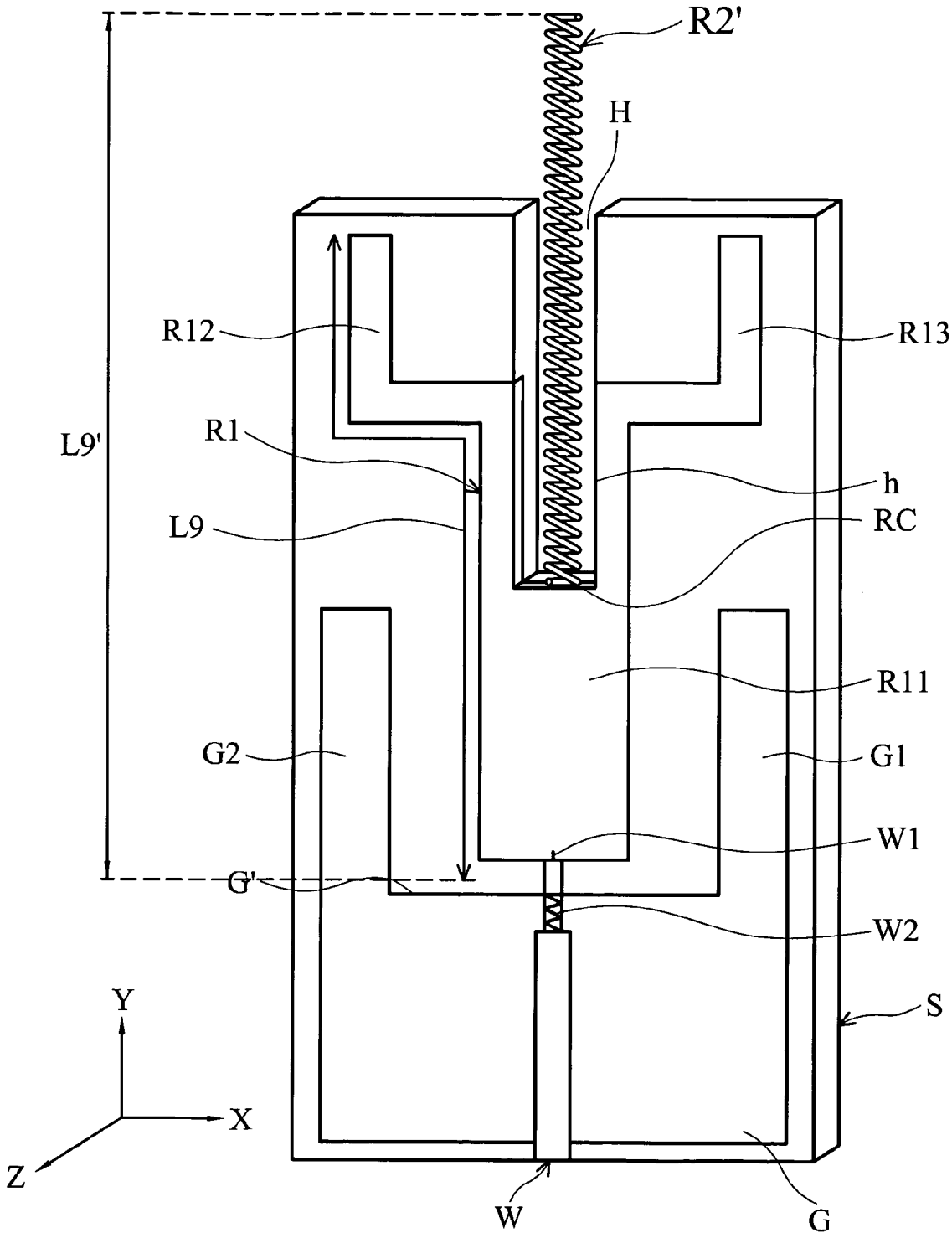
FIG. 8 is a perspective diagram of another embodiment of a monopole antenna.

FIG. 8 shows another embodiment of a monopole antenna combined with FIGS. 6 and 7. As shown in FIG. 8, the substrate S comprises a slot H, and the main body R11 of the first conductive element R1 comprises a depression h corresponding to the slot H. The second conductive element R2' is received in the slot H and connected to a connection portion RC of the first conductive element R1, wherein the connection portion RC is located at the bottom of the depression h. The two angle portions R12 and R13 symmetrically connect the main body R11 and extend in the first direction (direction Y).

In this embodiment, total length L9 of the main body R11 and each of the angle portions R12 and R13 is substantially equal to ¼ of a specific UHF radio signal wavelength. Further, total length L9' of the first and second conductive elements R1 and R2' in direction Y is configured corresponding to a specific VHF radio signal wavelength, and the length of the second conductive element R2' in direction Y is configured according to its spiral radius and actual extended length. Since the second conductive element R2' is received in the slot H, the extent of substrate S and the first conductive element R1 of the antenna is reduced in direction Y.

Figure 9:
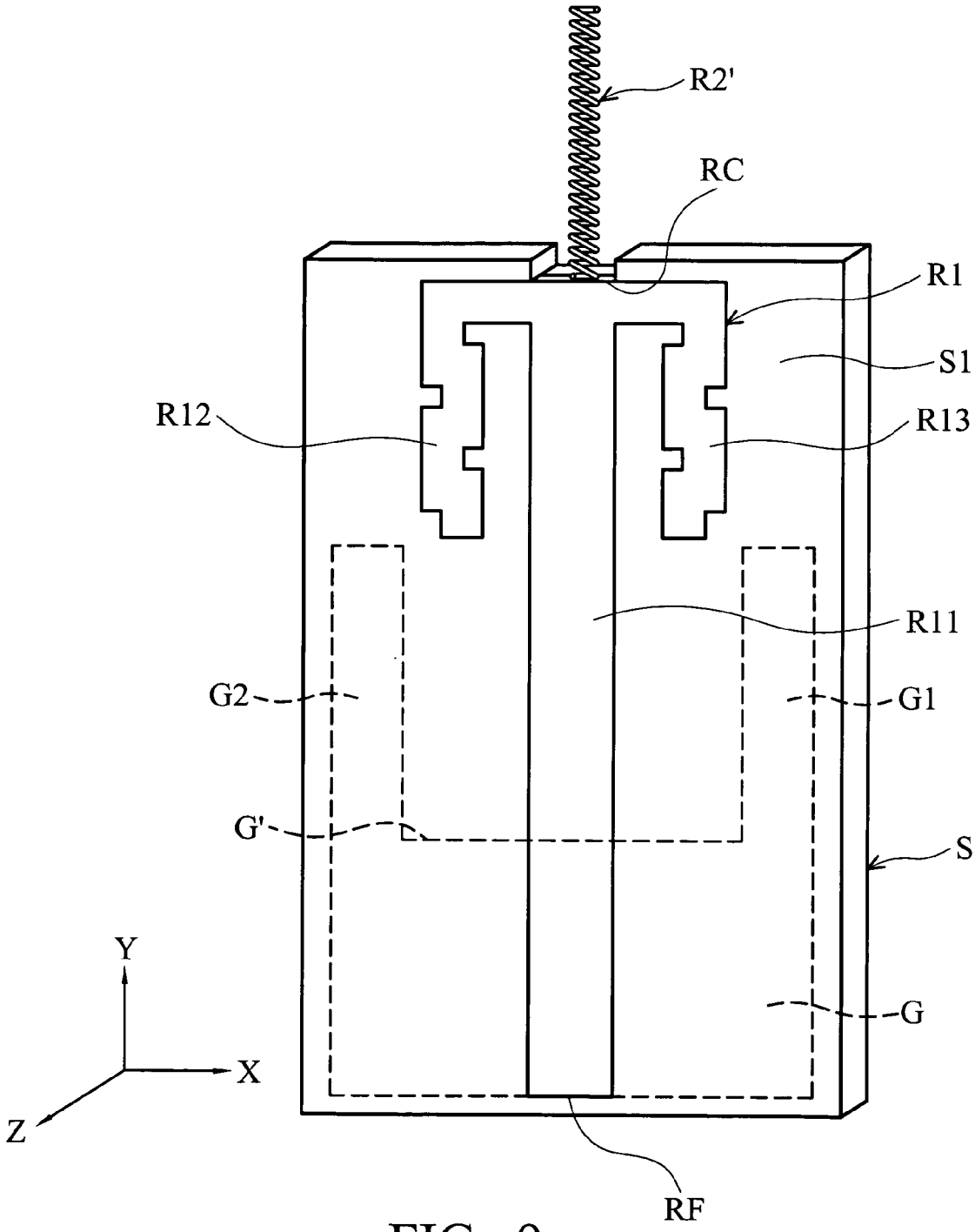
FIG. 9 is a perspective diagram of another embodiment of a monopole antenna.

FIG. 9 shows another embodiment of a monopole antenna. The monopole antenna, such as a microstrip antenna, comprises two angle portions R12 and R13 with zigzag structures symmetrically disposed on both sides of the main body R11. As shown in FIG. 9, the first sleeve G1, the second sleeve G2 and the ground G are formed on a different surface from the first conductive element R1. In this embodiment, the first sleeve G1, the second sleeve G2 and the ground G are formed on a surface of the substrate S different opposite to the first conductive element R1. A signal wire of a cable (not shown) is connected to the feed end RF at the bottom of the first conductive element R1, and a ground wire of the cable (not shown) is connected to the ground G on the opposite surface different from the feed end RF.

Figure 10:
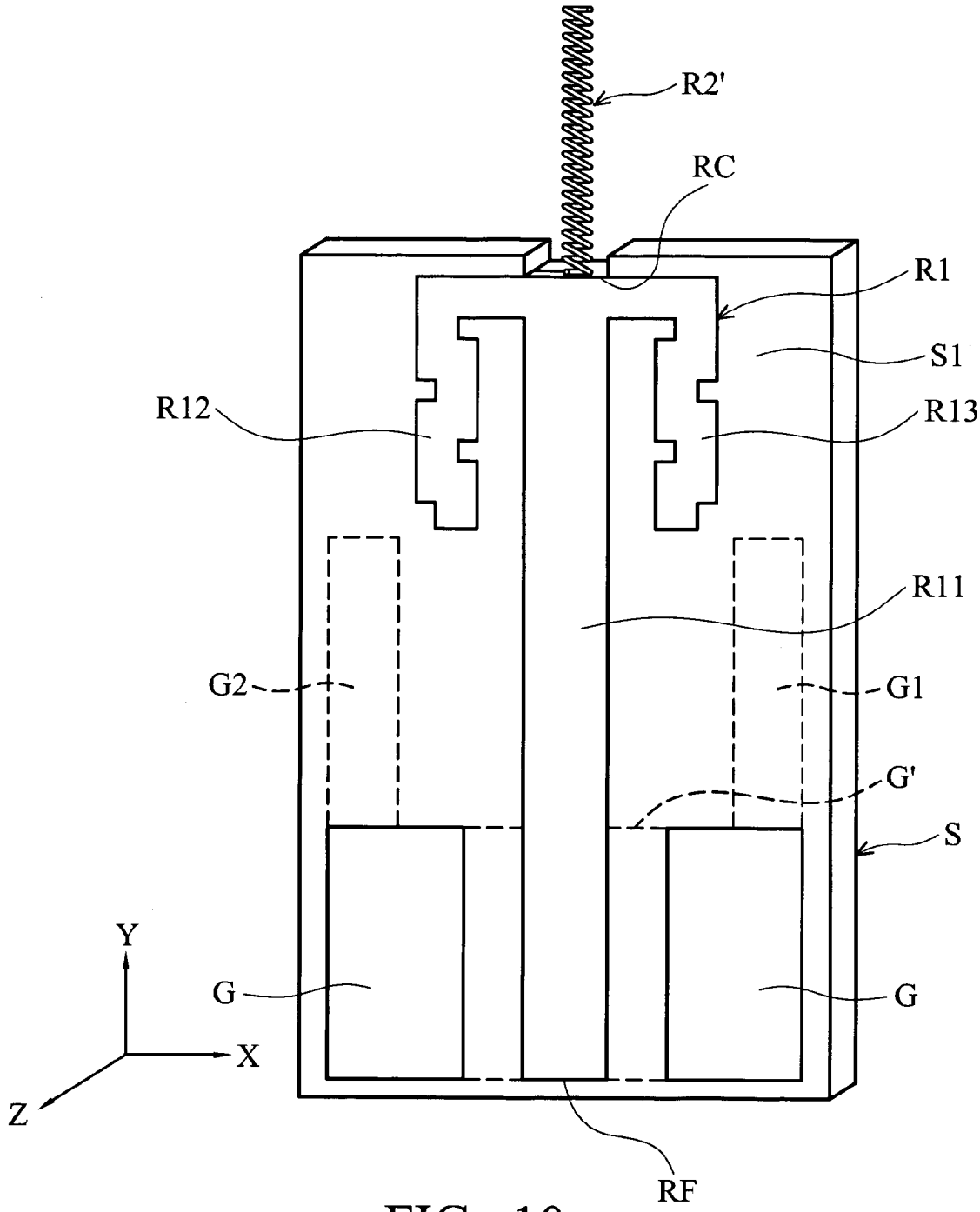
FIG. 10 is a perspective diagram of another embodiment of a monopole antenna.

FIG. 10 shows another embodiment of a monopole antenna. As shown in FIG. 10, the monopole antenna has a Coplanar Waveguide (CPW) feed configuration with the first conductive element R1 and parts of the ground G disposed on the same surface S1 of the substrate S. In this embodiment, the first and second sleeves G1, G2 and parts of the ground G are disposed on a surface of the substrate S opposite to the first conductive element R1, wherein the ground G, and the first and second sleeves G1 and G2 are electrically connected. A signal wire of a cable (not shown) is connected to the feed end RF at the bottom of the first conductive element R1, and a ground wire of the cable (not shown) is connected to the ground G on the same surface as the feed end RF.

With respect to the two embodiments in FIGS. 9 and 10, total length of the main body R11 and each actual extended length of the angle portions R12 and R13 is substantially equal to ¼ of a specific UHF radio signal wavelength. Further, total length of the first and second conductive elements R1 and R2' in direction Y is configured corresponding to a specific VHF radio signal wavelength, and the length of the second conductive element R2' in direction Y is configured according to its spiral radius and actual extended length.

Monopole antennas with symmetrical sleeve structures are provided according to the embodiments. The sleeve structures, ground and a first conductive element can be formed on a substrate by PCB fabrication, exhibiting capacitive effect and facilitating broader bandwidth for wireless communication. In some embodiments, the first conductive element is configured in different formations to facilitate miniaturization of the antenna. The second conductive element, such as the retractable conductor R2' in FIG. 2B or the spiral-shaped conductor R2' in FIGS. 4-10, connects the first conductive element and projects from an edge of the substrate, to facilitate wireless communication efficiency for VHF radio signals and provide a multifunctional monopole antenna for UHF/VHF radio signals. In some embodiments, the monopole antenna can also be used for GSM signal communications. As the monopole antenna provides better communication efficiency for UHF/VHF radio signals, it can be widely applied for UHF/VHF and DVB broadcast devices, such as digital TVs.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A monopole antenna transmitting a radio signal, comprising:
- a substrate;
- a ground formed on the substrate;
- a first sleeve portion, formed on the substrate and electrically connected to the ground, wherein the first sleeve portion projects from a side of the ground in a first direction;
- a second sleeve portion, formed on the substrate and electrically connected to the ground, wherein the second sleeve portion projects from the side of the ground in the first direction;
- a first conductive element, formed on the substrate, comprising a feed end and a connection portion adjacent to an edge of the substrate;
- a second conductive element, connecting the connection portion and projecting from the edge of the substrate in substantially the first direction; and
- a cable, connecting the ground and the feed end to transmit the radio signal.

2. The monopole antenna as claimed in claim 1, wherein the second conductive element is retractable.

3. The monopole antenna as claimed in claim 2, wherein the second conductive element comprises a plurality of sections telescopically connected along the first direction.

4. The monopole antenna as claimed in claim 2, wherein the second conductive element comprises two sections.

5. The monopole antenna as claimed in claim 1, wherein the second conductive element is spiral and projects from the edge of the substrate substantially in the first direction.

6. The monopole antenna as claimed in claim 1, wherein total length of the first and second conductive elements in the first direction is substantially ¼ of the radio signal wavelength.

7. The monopole antenna as claimed in claim 1, wherein the length of the first conductive element in the first direction is substantially ¼ of the radio signal wavelength.

8. The monopole antenna as claimed in claim 1, wherein the substrate comprises a slot with the second conductive element disposed therein, and the connection portion is located at the bottom of the slot and connected to the second conductive element.

9. The monopole antenna as claimed in claim 1, wherein the first conductive element comprises a longitudinal main body extending in the first direction and two angle portions connected to the main body, symmetrically disposed on opposite sides of the main body.

10. The monopole antenna as claimed in claim 9, wherein the angle portions are L-shaped.

11. The monopole antenna as claimed in claim 9, wherein the angle portions substantially extend along the first direction.

12. The monopole antenna as claimed in claim 9, wherein the angle portions substantially extend opposite to the first direction.

13. The monopole antenna as claimed in claim 9, wherein the angle portions connect the middle of the main body.

14. The monopole antenna as claimed in claim 9, wherein each of the angle portions comprises a zigzag structure symmetrically disposed with respect to the main body.

15. The monopole antenna as claimed in claim 9, wherein total length of the main body and each of the angle portions is substantially ¼ of the radio signal wavelength.

16. The monopole antenna as claimed in claim 9, wherein the substrate comprises a slot with the second conductive element disposed therein.

17. The monopole antenna as claimed in claim 16, wherein the main body comprises a depression corresponding to the slot, and the connection portion is located at the bottom of the depression and connected to the second conductive element.

18. The monopole antenna as claimed in claim 1, wherein the cable comprises a signal wire connecting the feed end and a ground wire connecting the ground, and the signal wire is enclosed by the ground wire.

19. The monopole antenna as claimed in claim 18, wherein the ground wire connects the ground at a first point, the signal wire connects the ground at a second point, and the first and second points are situated on different planes.

20. The monopole antenna as claimed in claim 18, wherein the first and second sleeve portions are situated on different planes from the first conductive element.

21. A monopole antenna transmitting a radio signal, comprising:

a substrate;

a ground, formed on the substrate;

a first conductive element, formed on the substrate, comprising a feed end and a connection portion adjacent to an edge of the substrate;

a second conductive element, connecting the connection portion and projecting from the edge of the substrate substantially in a first direction, wherein the second conductive element is retractable and comprises a plurality of sections telescopically connected along the first direction; and a cable, connecting the ground and the feed end to transmit the radio signal.

22. A monopole antenna transmitting a radio signal, comprising:

a substrate, comprising a slot;

a ground, formed on the substrate;

a first conductive element, formed on the substrate, comprising a longitudinal main body extending in a first direction and two angle portions connected to the main body, symmetrically disposed on opposite sides of the main body, wherein the main body has a feed end and a connection portion at the bottom of the slot;

a second conductive element, disposed in the slot and connected to the connection portion, extending substantially along the first direction; and a cable, connecting the ground and the feed end to transmit the radio signal.

23. The monopole antenna as claimed in claim 22, wherein the angle portions are L-shaped.

24. The monopole antenna as claimed in claim 23, wherein each of the angle portions comprises a zigzag structure symmetrically disposed with respect to the main body.

25. The monopole antenna as claimed in claim 22, wherein total length of the main body and each of the angle portions is substantially ¼ of the radio signal wavelength.

* * * * *